US011732572B2

(12) United States Patent
Hammond

(10) Patent No.: US 11,732,572 B2
(45) Date of Patent: Aug. 22, 2023

(54) METHOD AND SYSTEM FOR DETERMINING DEPTHS OF DRILL CUTTINGS

(71) Applicant: Schlumberger Technology Corporation, Sugar Land, TX (US)

(72) Inventor: Paul Simon Hammond, Bourn (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/653,469

(22) Filed: Mar. 4, 2022

(65) Prior Publication Data

US 2022/0186604 A1 Jun. 16, 2022

Related U.S. Application Data

(63) Continuation of application No. 16/465,835, filed as application No. PCT/US2017/057857 on Oct. 23, 2017, now Pat. No. 11,268,371.

(30) Foreign Application Priority Data

Oct. 21, 2016 (GB) ..... 1617804

(51) Int. Cl.
*E21B 47/04* (2012.01)
*E21B 49/00* (2006.01)
(Continued)

(52) U.S. Cl.
CPC ..... *E21B 47/04* (2013.01); *E21B 47/11* (2020.05); *E21B 49/005* (2013.01);
(Continued)

(58) Field of Classification Search
CPC ..... E21B 21/065; E21B 47/04; E21B 47/08; E21B 47/11; E21B 49/005; E21B 49/08
See application file for complete search history.

(56) References Cited

U.S. PATENT DOCUMENTS 4,739,655 A 4/1988 Greer et al.
4,904,603 A 2/1990 Jones et al.
(Continued)

FOREIGN PATENT DOCUMENTS

CN 102741504 A 10/2012
CN 103988498 A 8/2014
(Continued)

OTHER PUBLICATIONS

Combined Search and Examination Report issued in the related GB Application 1617804.8, dated Mar. 23, 2017 (6 pages).
(Continued)

*Primary Examiner* — Caroline N Butcher
(74) *Attorney, Agent, or Firm* — Rushi C. Sukhavasi

(57) ABSTRACT

Techniques for determining depths of provenance of drill cuttings contained in a drilling fluid received from a wellbore. The drilling fluid contains drill cuttings of different sizes that arrive at surface at different times, and the drill cuttings originate from different formation layers at different depths along the wellbore. Such techniques may include extracting samples of drill cuttings from the drilling fluid and repeating this step as necessary to provide samples of drill cuttings that arrive at surface at different recorded times; characterizing one or more formation attributes associated with the drill cuttings; and for each formation attribute, estimating a distribution of formation attribute characterization versus depth of provenance.

20 Claims, 6 Drawing Sheets

(51) Int. Cl.

| | |
|---|---|
| ***E21B 47/11*** | (2012.01) |
| ***E21B 49/08*** | (2006.01) |
| *E21B 21/06* | (2006.01) |
| *E21B 47/08* | (2012.01) |

(52) U.S. Cl.
CPC ..... *E21B 21/065* (2013.01); *E21B 47/08* (2013.01); *E21B 49/08* (2013.01)

(56) References Cited

U.S. PATENT DOCUMENTS

| | | | | |
|---|---|---|---|---|
| 5,571,962 | A * | 11/1996 | Georgi | E21B 21/065 175/46 |
| 9,046,509 | B2 | 6/2015 | Dvorkin et al. | |
| 9,372,162 | B2 | 6/2016 | Ganz | |
| 2010/0193184 | A1 | 8/2010 | Dolman et al. | |
| 2012/0325465 | A1 | 12/2012 | Hammer et al. | |
| 2015/0226049 | A1* | 8/2015 | Frangos | E21B 49/00 702/6 |
| 2016/0130928 | A1 | 5/2016 | Torrione | |
| 2019/0368336 | A1 | 12/2019 | Hammond | |

FOREIGN PATENT DOCUMENTS

| | | | |
|---|---|---|---|
| CN | 105378219 | A | 3/2016 |
| WO | 2012177897 | A2 | 12/2012 |
| WO | 2015072962 | A1 | 5/2015 |
| WO | 2016062388 | A1 | 4/2016 |

OTHER PUBLICATIONS

Examination Report issued in the related GB Application 1617804.8, dated Nov. 15, 2018 (3 pages).

International Search Report and Written Opinion issued in the related PCT Application PCT/US2017/057857, dated Feb. 7, 2018 (17 pages).

International Preliminary Report on Patentabiligy issued in the related PCT Application PCT/US2017/057857, dated Apr. 23, 2019 (13 pages).

Gill, P.E., W. Murray, and M.H.Wright, Practical Optimization, London, Academic Press, 1981; sections 6.4 to 6.6 (45 pages).

* cited by examiner

METHOD AND SYSTEM FOR DETERMINING DEPTHS OF DRILL CUTTINGS

This application is a continuation of U.S. patent application Ser. No. 16/465,835 filed May 31, 2019, now U.S. Pat. No. 11,268,371, which is a National Phase filing of PCT Application No. PCT/US201/057857 filed Oct. 23, 2017 which claims priority to United Kingdom Application No. 1617804.8, filed Oct. 21, 2016, all of which are herein incorporated by reference.

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

The present disclosure relates generally to methods and systems for analysing drill cuttings received at the surface from a wellbore, including without limitation to methods and systems for determining depth of provenance of the drill cuttings.

BACKGROUND

Geologists and engineers attempt to determine the properties of geological formations of a wellbore in order to make effective decisions about drilling and producing hydrocarbons from the wellbore. Such properties can provide useful information about the likely presence or absence of hydrocarbons and/or the state of a drilling operation. To assess the properties of a geological formation, drill cuttings removed from the wellbore during a drilling operation are collected and analysed.

Drill cuttings are produced as rock is broken by the drill bit advancing through a rock formation. The drill cuttings usually are carried to the surface by a drilling fluid (also known as mud or drilling mud) circulating up from the drill bit so that the drill cuttings are removed from the well to avoid clogging. The drilling fluid is pumped into the well through the drill string and returned to the surface through the annulus between the drill string and the wellbore.

At the surface, drill cuttings come in various sizes and may be separated from the drilling fluid by screens or sieves, gravity settling, centrifugal or elutriation techniques. The average size of the cuttings from a wellbore may depend on the formation hardness and other physical properties of the formation, type of drill bit and rate of penetration. By a "formation" we mean of a succession of rock strata, typically along a depth scale with comparable lithology or other similar properties (e.g., color, fossil content, age, chemical composition, physical properties, etc.). The term "formation" may also refer to a group of rocks within a depth range in a drilled well.

Useful properties of geological formations determined from drill cuttings include the composition of the formation, which can provide information about materials present in the formation corresponding to various depths of the well. Correctly determining the depth of provenance of the drill cuttings is therefore desirable in order to accurately determine properties of the geological formation at various depths within the wellbore.

At present, the depth of a cutting is usually assessed by correlating the depth of the drill bit with the drilling fluid velocity within the wellbore. For example, it is assumed that if it takes one hour for the fluid to flow from drill bit to surface, then cuttings exiting the well now must have originated from the depth at which the drill bit was located one hour ago. Such simple calculations, however, are prone to measurement errors because they do not account for all of the factors affecting the transport properties of drill cuttings.

Other known methods of determining depth of provenance include Measurement While Drilling (MWD) gamma ray logging and correlating such logs with gamma ray measurements made on the cuttings at the surface. Such methods, however, are costly and not always available.

Estimating the depth of provenance is important for both conventional and unconventional hydrocarbon well drilling. Typically, conventional hydrocarbons include crude oil and natural gas and its condensates. Unconventional hydrocarbons (e.g. shale gas or shale oil) typically include a wider variety of liquid sources including oil sands, extra heavy oil, gas to liquids and other liquids. While difficult to accurately estimate at present, the depth of provenance of larger cuttings is of particular interest in conventional hydrocarbon drilling as large cuttings can allow for geometry-dependent quantities such as porosity or permeability to be estimated. Large cuttings also allow for intact micro fossils to be identified for correlation purposes.

Moreover, an important design consideration when planning the completion of an unconventional hydrocarbon well (i.e. a shale gas or shale oil well) is where to place hydraulic fractures along a near-horizontal portion of the well. Presently, these are often located according to a geometrical criterion decided before the well is even drilled, for example they are placed at equispaced intervals between the toe and heel of the well. The hydrocarbon productivity of a well could be improved if the fractures were located in the most favorable portions of the formation, for example those where producible hydrocarbon content is greatest. To accomplish this, it is necessary to characterize the actual properties of the formation along the length of the well so that the best zones can be identified, and this requires access in some form to be available to the formation so that the necessary measurements can be made.

BRIEF SUMMARY

The methods and systems of the present disclosure provide improved estimations of depths at which drill cuttings originate in both conventional and unconventional wells. For example, the present disclosure provides a method of determining depths of provenance of drill cuttings contained in a drilling fluid received from a wellbore, the drilling fluid containing drill cuttings of different sizes that arrive at the Earth's surface at different recorded times, the drill cuttings originating from different formation layers at different depth along the wellbore. Such methods may include, for non-limiting example, the steps of:

a) extracting a first sample of drill cuttings from the drilling fluid, wherein the drill cuttings in the first sample are smaller than a first predetermined threshold;

b) repeating step a) to provide a plurality of first samples of drill cuttings that arrive at the Earth's surface at different recorded times;

c) characterising drill cuttings in the plurality of first samples comprising characterizing one or more formation attributes associated with the drill cuttings of the first samples; and d) for each formation attribute characterized at step c), estimating a distribution of formation attribute characterization versus depth of provenance, comprising defining a hydrodynamic transport within the drilling fluid of the drill cuttings characterized at step c) including the effect of diffusion and dispersion on the hydrodynamic transport.

The methods of the present disclosure thus solve the problem of correctly assigning cuttings extracted from drilling fluid to the depths from which they originated in the well referred to as "depths of provenance". In contrast to known methods highlighted above, the methods of the present disclosure account for the fact that there is a usually a spread in the size of cuttings transported by a drilling fluid at different rates, with smaller cuttings moving at a velocity close to that of the drilling fluid, while larger cuttings being slowed by a number of factors. In particular, larger cuttings tend to settle in the drilling fluid and/or form beds on the low side of the well, as well as experience a non-flat velocity profile, all of which lead to the mean velocity of transport of the large cuttings to surface being less, by an unknown and variable amount, than the known mean velocity of the drilling fluid. That is, there is significant slippage between the large cuttings and the drilling fluid, together with size-dependent axial hydrodynamic dispersion.

The effect of selecting drill cuttings smaller than a predetermined threshold (i.e. according to a selected sieve size) is to obtain a first sample of "fine" or "small" cuttings that can be assumed to be carried with the drilling fluid. The methods of the present disclosure recognize that sufficiently small (fine) cuttings are well suspended in the drilling fluid, and so the small cuttings move with the known speed of the flow. Furthermore, it is recognized that there is hydrodynamic diffusion acting on the small cuttings which is comparatively well understood, and so can be corrected for. In embodiments, the correction is made by using an analytical solution of the advection-diffusion equation; numerical solutions of the advection-diffusion equation also may be used. The result is a more accurate estimation of transport times of the drill cuttings, and thus more accurate ascriptions of drill cuttings' depths of origin.

A "formation attribute" associated with a drill cutting is a property of the drill cutting that may include structural parameters or color for example. It will be appreciated that this characterization information may be in addition to the chemical composition identified by determining the compound species. The characterization may be performed using one or more methods known in the art, including for non-limiting example: Infra-red Spectroscopy (IR), ultraviolet spectroscopy, optical spectroscopy, gas chromatography, NMR or nuclear methods, mass spectrometry, thermo-gravimetric analysis, pyrolysis, thermal extraction, wet chemical analysis, and/or x-ray techniques for elemental content. For completion planning of unconventional wells applications, characterising the small cuttings may include one or more of: total organic carbon content, kerogen content, bitumen content, hydrocarbon content (total or fractionated into molecular weight ranges), organic content, and inorganic mineralogy.

Estimating a formation attribute distribution in step d) may comprise calculating a lag time for the drilling fluid using the recorded times of the drilled cuttings in the first sample, drilling fluid speed, and speed of drill penetration. The distribution may also be a deblurred log (or the probability thereof) of formation composition versus depth as derived from small cuttings data, for non-limiting example from samples or images obtained by manual or automated means (e.g. RockWash™ automated rock-sample washing and photographic process). "Deblurring" refers to correction for the effects of hydrodynamic diffusion of small cuttings within the drilling mud, also known as dispersion.

In embodiments, correcting for a hydrodynamic diffusion effect on the transport may include a Bayesian statistical calculation. Making the correction in a Bayesian manner can exploit prior knowledge about the transport processes and/or about the character of formation composition variations for example, thereby improving accuracy of correction and thus depth estimation over known methods. Further constraints such as concentrations being non-negative also may be included.

In embodiments, estimating a distribution of formation attribute over depth of provenance may include solving a set of equations and/or correcting for dilution effects on an identified formation attribute during transport by the drilling fluid to improve accuracy of depth estimation.

In embodiments, methods of the present disclosure may further comprise e) extracting a second sample of at least one drill cutting wherein the at least one drill cutting in the second sample is larger than a second predetermined threshold; f) characterising the drill cutting(s) in the second sample, comprising characterising one or more formation attributes associated with the drill cutting(s) in the second sample; and g) correlating the characterized formation attributes associated with the drill cutting(s) in the second sample with the distributions estimated at step d), to thereby associate a depth of provenance with the drill cutting(s) in the second sample. Information derived from the small cuttings collected manually or automatically at surface is then used to better characterize the larger cuttings, selected according to a minimum threshold (e.g. a sieve size).

In embodiments, the second predetermined threshold is larger than the first predetermined threshold so that "larger" cuttings are present in the second samples than in the first samples. For example, the first predetermined threshold for the small cuttings might be 1 mm and the second predetermined threshold for the large cuttings may be 2 mm. The result is a more accurate estimation of transport times of the large cuttings, and thus more accurate ascriptions of the large cuttings' depths of origin. Determining the depth of provenance of the larger cuttings can allow for geometry-dependent quantities such as porosity or permeability to be estimated. Large cuttings also allow for intact micro fossils to be identified for correlation purposes.

In embodiments, correlating the characterized composition and/or formation attributes associated with the drill cutting(s) in the second sample with the estimated distributions of formation attribute characterization versus depth of provenance in step g) may comprise matching the formation attributes associated with the drill cutting(s) in the second sample as identified at step f) with the one or more distributions estimated at step d).

In embodiments, the methods of the present disclosure may further comprise defining a transport model for the drill cutting(s) in the second sample, using the results of step g) to constrain the transport model, and calculating a depth of provenance for the drill cutting(s) using the constrained transport model. As will be described in more detail below, the transport models can include time-varying parameters or tracers for example, to provide a more realistic assessment of transport times and thus depth estimation. A tracer may be included in the drilling fluid to be injected into the wellbore and a travel time may be determined for the tracer within the drilling fluid to further constrain the transport model, wherein the tracer has a similar composition and/or size to the drill cutting(s) in the second sample and is insoluble in the drilling fluid. Tracers are known in the art and may be selected to have similar properties to a large cutting of interest for example in order to obtain a more accurate transport model.

Where it is difficult to extract a "clean" small sample from the drilling fluid, for example if the sample includes drilling fluid, in embodiments methods of the present disclosure may include characterizing the composition of drilling fluid injected into the wellbore, and subtracting the composition of the drilling fluid from a total composition of drill cuttings in the first sample, to provide for a more accurate characterization of small cuttings samples.

The present disclosure also provides a system for determining depths of provenance of drill cuttings contained in a drilling fluid received from a wellbore, the drilling fluid containing drill cuttings of different sizes that arrive at the Earth's surface at different recorded times, the drill cuttings originating from different formation layers at different depth along the wellbore. Systems of the present disclosure may include for non-limiting example: a drill cutting extraction unit for repeatedly extracting first samples of drill cuttings from the drilling fluid, to provide to provide a plurality of first samples of drill cuttings that arrive at the Earth's surface at different recorded times, wherein the drill cuttings in the first samples are smaller than a first predetermined threshold; a sample analyser for characterizing drill cuttings in the plurality of first samples, including characterising one or more formation attributes associated with said drill cuttings of the first samples; and a computer processor programmed to carry out instructions comprising: for each of the one or more formation attributes characterized, estimating a distribution of formation attribute characterization versus depth of provenance including solving a set of equations which define a hydrodynamic transport within the drilling fluid of the drill cuttings characterized, for example the effect of diffusion and dispersion on the hydrodynamic transport. It should be appreciated that, like the methods of the present disclosure, the systems of the present disclosure may be applied to drilling of both conventional and unconventional hydrocarbon wells.

Obtaining greater depth accuracy of cuttings can translate into better decisions about completion operations associated with the wellbore. For example, since the economics of drilling unconventional wells are such that formation evaluation by wireline logging is not routinely performed, analysis of the drilled cuttings is an attractive way to get the desired information because it does not greatly impact or add time to the normal process of drilling the well. For unconventional oil drilling applications, it is not necessary to have access to large cuttings in order to determine the solid hydrocarbon content since what is of interest is the formation composition, and not in any properties depending on the geometrical structure of the rock or its void space.

In other embodiments, the present disclosure provides methods of determining depths of provenance of drill cuttings contained in a drilling fluid received from a wellbore, the drilling fluid containing drill cuttings of different sizes that arrive at the Earth's surface at different recorded times, the drill cuttings originating from different formation layers at different depth along the wellbore the method comprising for non-limiting example:

a) extracting first samples of drill cuttings from the drilling fluid, wherein the drill cuttings in the first samples are smaller than a first predetermined threshold;

b) repeating step a) at least once to provide a plurality of first samples of drill cuttings that arrive at the Earth's surface at different recorded times;

c) characterizing drill cuttings in the plurality of first samples, including characterising one or more formation attributes associated with the drill cuttings of the first samples;

d') for each formation attribute characterized at step c), estimating a distribution of formation attribute characterization versus depth of provenance, wherein estimating the distribution comprises defining a hydrodynamic transport within the drilling fluid of the drill cuttings characterized at step c);

e) extracting a second sample of at least one drill cutting wherein the drill cutting(s) in the second sample are larger than a second predetermined threshold;

f) characterizing the at drill cutting(s) in the second sample, including identifying one or more formation attributes associated with the drill cutting(s) in the second sample; and g) correlating the characterized formation attributes associated with the drill cutting(s) in the second sample with the distributions estimated at step d'), to thereby associate a depth of provenance with the drill cutting(s) in the second sample.

This may be advantageous in conventional drill cutting in order to determine depth of provenance of large cuttings. These embodiments combine estimating a distribution versus depth of provenance, i.e. log or the probability thereof of formation composition versus depth as derived from small cuttings data (d'), with correlating the characterized composition of a "large" cutting with the estimated distributions (g). The log of formation distribution may or may not be "deblurred". Accordingly, step d') does not include correcting for a hydrodynamic diffusion effect on the transport (as included in step d) above. In some embodiments, however, step d') may comprise correcting for a hydrodynamic diffusion effect on the transport, in order to increase accuracy of depth estimation.

BRIEF DESCRIPTION OF THE DRAWINGS

For a detailed description of embodiments of the present disclosure, reference will now be made to the accompanying drawings in which.

DETAILED DESCRIPTION

Figure 1:
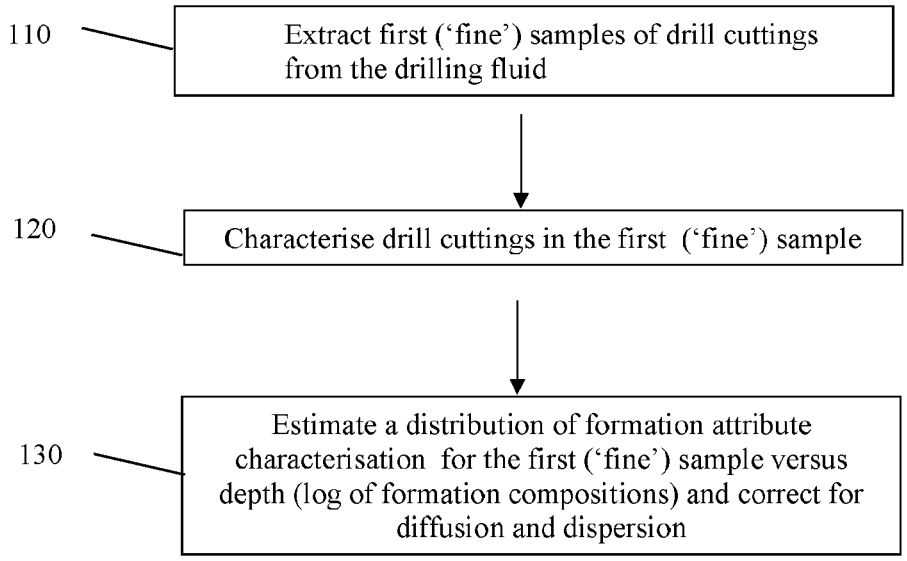
FIG. 1 illustrates methods according to one or more embodiments of the present disclosure.

Reference will now be made in detail to embodiments, examples of which are illustrated in the accompanying drawings and figures. In the following detailed description, numerous specific details are set forth in order to provide a thorough understanding of the subject matter herein. However, it will be apparent to one of ordinary skill in the art that the subject matter may be practiced without these specific details. In other instances, well-known methods, procedures, components, and systems have not been described in detail so as not to unnecessarily obscure aspects of the embodiments.

This discussion is directed to various embodiments of the disclosure. The drawing figures are not necessarily to scale. Certain features of the embodiments may be shown exaggerated in scale or in somewhat schematic form, and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application and that the discussion of any embodiment is meant only to be exemplary of that embodiment, and not intended to intimate that the scope of the disclosure, including the claims, is limited to that embodiment.

The terminology used in the description of the disclosure herein is for the purpose of describing particular embodiments only and is not intended to be limiting of the subject matter. When introducing elements of various embodiments of the present disclosure and claims, the articles "a," "an," "the," and "said" are intended to mean that there are one or more of the elements. The term "and/or" as used herein refers to and encompasses any and all possible combinations of one or more of the associated listed items. The terms "comprising," "including," and "having" are used in an open-ended fashion, and thus should be interpreted to mean "including, but not limited to . . . ."

As used herein, the term "if" may be construed to mean "when" or "upon" or "in response to determining" or "in response to detecting," depending on the context. Similarly, the phrase "if it is determined" or "if (a stated condition or event) is detected" may be construed to mean "upon determining" or "in response to determining" or "upon detecting (the stated condition or event)" or "in response to detecting (the stated condition or event)," depending on the context.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

Implementing aspects of the present disclosure requires the collection of drill cuttings for analysis and measurement of cuttings composition, whether by manual or automated means.

Deriving a Log of Formation Composition Versus Depth (from Small Cuttings)

Figure 2:
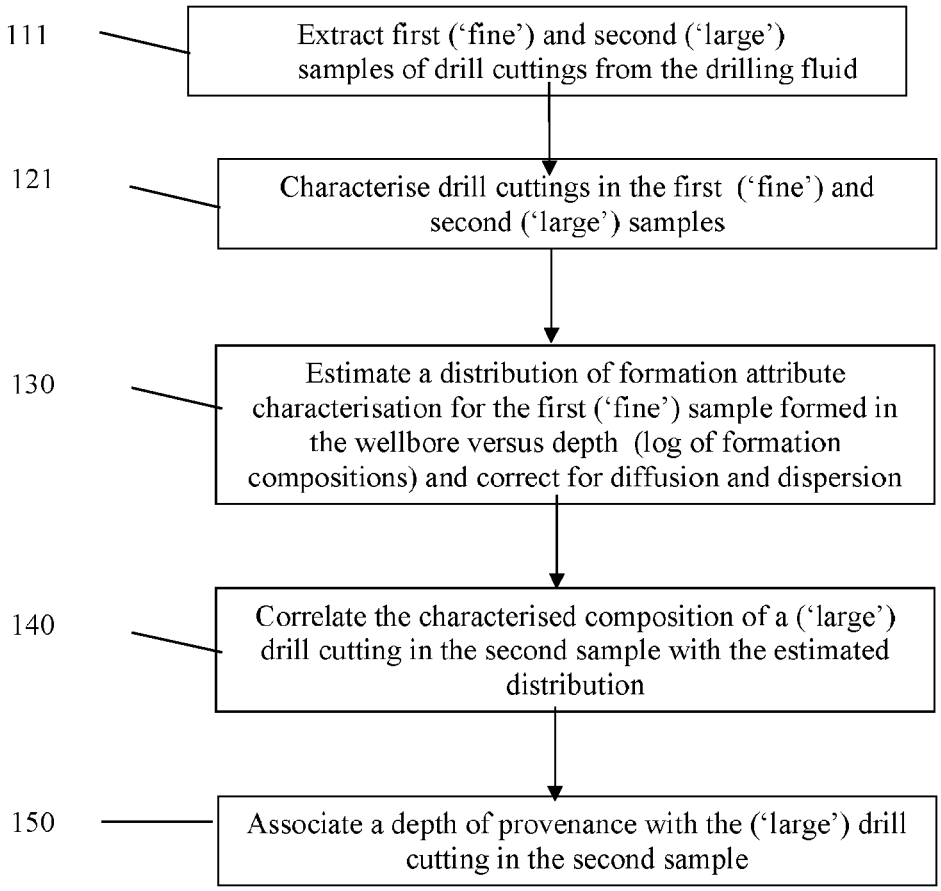
FIG. 2 illustrates another method according to tone or more embodiments of the present disclosure.
Figure 3:
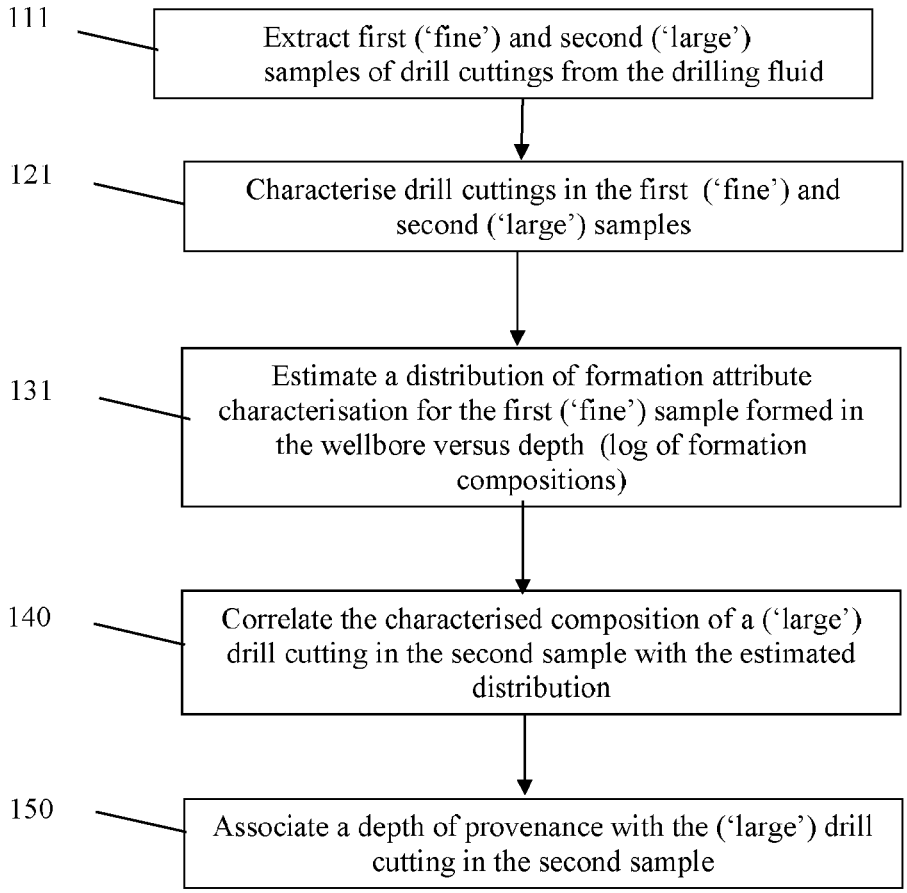
FIG. 3 illustrates a method according to one or more embodiments of the present disclosure.

Referring now to the drawings, FIGS. 1 1, 2 and 3 each schematically illustrate methods of determining depths of provenance of drill cuttings contained in a drilling fluid received from a wellbore, the drilling fluid containing drill cuttings of different sizes that arrive at the Earth's surface at different recorded times. The drilling fluid (also known as drilling mud) contains a spectrum of cutting sizes, from large sized cut material down to very finely sized cut material. The drill cuttings are generated during wellbore drilling operations and samples may be collected at the surface (wellbore exit) from the annulus. An example of an apparatus used for extracting and separating the drill cuttings from the drilling fluid is described for example in U.S. Pat. No. 5,571,962.

Turning to FIG. 1, at step 110, first samples of drill cuttings are extracted from the drilling fluid, and the drill cuttings in the first sample are chosen to be smaller than a predetermined threshold. Second samples of drill cuttings also may be extracted, to obtain 'large' drill cuttings bigger than a second predetermined threshold, and this step is represented in FIGS. 2 and 3, at 111. The second predetermined threshold is larger than the first predetermined threshold so that 'large' cuttings present in the second sample are larger than the 'small' cuttings present in the first samples. Drill cuttings may be extracted by means of a shale shaker or similar known device, and such extraction may be manual, automated, or a combination, and may include or incorporate known methods for associated data collection (for example RockWash™). The drill cuttings may be classified and grouped based on times they arrive at the surface using known methods. This step is then repeated to obtain a log of time-series associated with the extracted drill cuttings.

The selection of the 'small' cuttings in the first sample may be made by a suitably sized sieve defining a maximum size for the cuttings in the first sample. The effect of selecting drill cuttings smaller than a predetermined threshold is to obtain a first sample of 'fine' or 'small' cuttings that can be assumed to be carried with the drilling fluid. The assumption is thus that the small drill cuttings in the first sample are transported to the surface by the flowing bulk mud because they would be kept in suspension by yield stress effects, turbulence or Brownian motion. Accordingly, such 'small' cuttings may be reasonably assumed not to slip much locally relative to the continuous phase of the drilling fluid because of strong viscous drag. In practice small cuttings might be smaller than 1 mm in maximum diameter, and large cuttings bigger than 2 mm in maximum diameter.

For example, the drilling fluid including the mixture of drill cuttings at various sizes may be separated for example using a sieve so as to obtain a series of samples of various size relatively smaller cuts containing no large cuttings and a sample of 'large' cuttings from which single large cuttings may be selected. In embodiments therefore the selected large cuttings are greater than a second predetermined threshold. As explained above, the larger cuttings are of particular interest because they allow geometry-dependent quantities to be estimated and also allow intact microfossils to be identified for correlation purposes. The first and second samples of 'small' and 'large' cuttings, respectively, are sometimes referred to as 'wet' and 'dry' samples, respectively.

The samples are then prepared for measurement, for example cleaned further and ground up to a very fine state. At step 120 of FIG. 1 compositions and constituents (e.g. chemical compounds, minerals or elements present etc.), characteristics (e.g. physical properties such as density etc.) and attributes (e.g. color, characteristic distinguishing features including descriptors of shape and size etc.) of drill cuttings in the extracted samples and associated information obtain manually and/or automatically (e.g. via RockWash™ etc.) are characterized (this step corresponding to step 121 in FIGS. 2 and 3). The extracted samples are characterized using one or more methods known in the art such as: Infra-red Spectroscopy (IR), ultraviolet spectroscopy, optical spectroscopy, gas chromatography, NMR or nuclear methods, mass spectrometry, thermos-gravimetric analysis, pyrolysis, thermal extraction, wet chemical analysis, and x-ray techniques for elemental content. For completion planning of unconventional wells applications, characterizing the small cuttings may include one or more of the following: total organic carbon content, kerogen content, bitumen content, hydrocarbon content (total or fractionated into molecular weight ranges), organic content, and inorganic mineralogy.

In embodiments, samples of the injected drilling fluid being pumped into the wellbore are also collected and the composition of the injected drilling fluid is determined by known methods. The measured composition of the injected drilling fluid may then be subtracted from the composition of the small cuttings sample. The known composition of the drilling fluid is thus regarded as a reference 'mud' signal data. For example, since barite is uniquely present in the drilling fluid, measuring the barite of the 'wet' sample indicates how much of the reference 'mud' signal data to subtract. As a result, the formation composition of the drill cuttings in the first sample may be estimated more accurately.

An example describing using known barite content of drilling fluid to determine the fraction of drilling fluid contained in a wet sample of small cuttings is described herewith. From measuring at surface, it is determined that the injected drilling fluid contains by mass 10% barite, and 25% of a material "A" which is also found in the formations being drilled. It is further measured that a wet sample of small cuttings contains by mass 2% barite and 50% of "A". Since barite is not normally found in downhole formations, it can be concluded that the wet sample of small cuttings is made up one fifth of drilling fluid, and four fifths of dry small cuttings. Under that assumption that there is no preferential separation or concentration of material from the drilling fluid in the 'wet' sample of small cuttings, it can be inferred that "A" from the drilling fluid contributes 5% to the total mass of the wet sample. The remaining "A" in the wet sample must come from the formation, and by subtraction makes up 45% of the total mass of the wet sample. The mass fraction of "A" in the dry small cuttings is therefore (mass of "A" from formation in the total sample)/(total mass of dry small cuttings in the total sample)=(45%)/(80%)=0.5625.

It will be appreciated that the cleaning of the recycled drilling fluid for example in the shakers or hydrocyclones is often less than perfect. Therefore, reference 'mud' signal data may be taken frequently to ensure that its composition estimate is accurate (particularly where the composition of solids present in the drilling fluid is very close in composition to the small cuttings).

At step 130 shown in both FIGS. 1 and 2, for one or more compounds identified in the characterized cuttings of the first sample, a distribution of an amount of the compound formed in the wellbore versus depth of provenance is estimated and a correction for diffusion is performed. The distribution is also referred to as a log of formation composition versus depth for the small cuttings. Estimating the distribution comprises solving a set of equations which define a hydrodynamic transport of the compound within the drilling fluid and correcting for diffusion effects.

In particular, a probability distribution for a log of formation composition may be derived from the measured time series of small cuttings, making a number of assumptions as follows. The drilling fluid leaving the well at surface is assumed to contain a spectrum of drill cuttings sizes, from large all the way down to very finely ground material. While the large cuttings slip and experience significant hydrodynamic dispersion, the very smallest cuttings are carried with the flowing bulk 'mud' because they are kept in suspension by yield stress effects, turbulence or Brownian motion, and do not slip much locally relative to the continuous phase because of strong viscous drag.

The frequency with which small cuttings samples are collected at surface should be related to the spatial resolution which it is desired to achieve in the log of formation composition, and the spatial resolution required in the formation log is related to the intended use to which it will be put and the anticipated length scales of variation of the formation. For example, if it is known from offset well data that formation properties vary on a 10 meter length scale along the hole, and that this variation will need to be taken account of when planning a hydraulic fracturing completion, and if it is further known that the rate of penetration while drilling that section of hole is likely to be around 100 metres per hour, then small cuttings samples should be taken at least every one tenth of an hour (i.e. 6 minutes) or more frequently. On the other hand, if the interest is only to determine structure on the greater than 100 meter length scale then samples taken hourly may be sufficient. In very general terms, in certain embodiments, small cutting samples may be taken at time intervals corresponding to depth resolutions of about 1 to about 100 meters, and in other embodiments, small cutting samples may be taken at time intervals corresponding to depth resolutions in a range of about 5 to about 50 metres.

The injected mud flow rate as well as the annulus area versus depth may be measured and thus represent known parameters. If one further assumes absence of kicks and losses, the overall hydrodynamic transport of fine cuttings may thus be calculated, and the amount of hydrodynamic dispersion (e.g. Taylor dispersion) is corrected for (at step 130 of FIGS. 1 and 2) by applying a deblurring operator for example. As above, 'deblurring' refers to correction for the effects of hydrodynamic diffusion of small cuttings within the drilling mud. A probability distribution for a log of formation composition versus depth then may be derived from the measured time series of fine cuttings compositions at surface.

In particular, the effects of dispersion of the transport of small cuttings may be modelled as follows. An example of a set of equations being solved to determine the log of formation distribution versus depth is given below although it will be appreciated that the equations may vary depending on the chosen model and known or assumed parameters.

The concentration (mass per unit volume) of formation material of species i at the exit of the well, $W_i(0,t)$, may be computed from an analytical solution of the advection-diffusion equation $$\frac{\partial W_i}{\partial t} - V\frac{\partial W_i}{\partial x} - D\frac{\partial^2 W_i}{\partial x^2} = UW_i^{rock}(L(t))\delta(x - L(t)), \tag{1}$$

obtained through linear superposition in the form $$W_i(0, t) = \int_0^t UW_i^{rock}(L(t'))\frac{\exp(-(V(t-t') - L(t'))^2/(4D(t-t')))}{\sqrt{4\pi D(t-t')}}dt'. \tag{2}$$

where U is the (dimensionless) rate of penetration assumed constant in time, $L(t)=L_0+Ut$ is the (dimensionless) depth of the drill bit, V is the (dimensionless) drilling fluid ('mud') circulation velocity assumed constant in time, $W_i^{rock}$ is the composition of the formation, and D is the (dimensionless) coefficient of axial dispersion/diffusion assumed constant.

In some embodiments, the analytical solution (2) may be replaced with a numerical solution taking account of non-constant annulus cross sectional area, of time-varying values of U and V, and using more realistic values for D, for example making D dependent on V so as to better represent Taylor dispersion.

For reference it is noted that in conventional interpretation (i.e. prior art), compositions measured at the surface may be lagged to downhole locations according to depth of provenance of cuttings emerging at t, $$L(t) = \frac{V}{U+V}(Ut + L_0) \tag{3}$$

and compositions may be corrected for dilution effects using the following equation:

$$W_i^{rock}(L(t)) = \frac{U+V}{U}W_i(0, t) \tag{4}$$

It is known by practitioners how to generalize these expressions to take account of time-varying mud circulation rate and rate of penetration U and V.

The above exemplary equations assume that the drilling fluid flow rates and rate of penetration are constant in time, but these parameters could alternatively be assumed to vary in time and a numerical solution performed taking this into account Equation (2) may be written as: $W_i(0,t)=\int_0^t W_i^{rock}(t')f(t-t',t')dt'$.

Next, the observed small cuttings composition data, $W_i(0,t)$, may be converted to a downhole log of composition, $W_i^{rock}(x)$. There are many mathematical algorithms which can be employed, but one possible approach is to minimize a suitably selected norm of the desired output, say $\|W_i^{rock}(x)\|_1$ subject to constraints of non-negativity, $W_i^{rock}(x)\geq 0$, and $\|W_i(0,t_j)-\int_0^{t_j}W_i^{rock}(L(t'))f(t_j-t',t')dt'\|_1\leq\sigma$ which expresses consistency with the M observations, σ being an estimate of the error levels in the data. The use of the 1-norm seems to give better results than the 2-norm in this context. The parameters {U,V,D} of G may be treated as known, or some or all of them may be estimated as part of the process.

The steps of FIG. 3 correspond to those of FIG. 2, except that step 131 in FIG. 3 does not include the deblurring or correction for diffusion effects described above.

Figure 4:
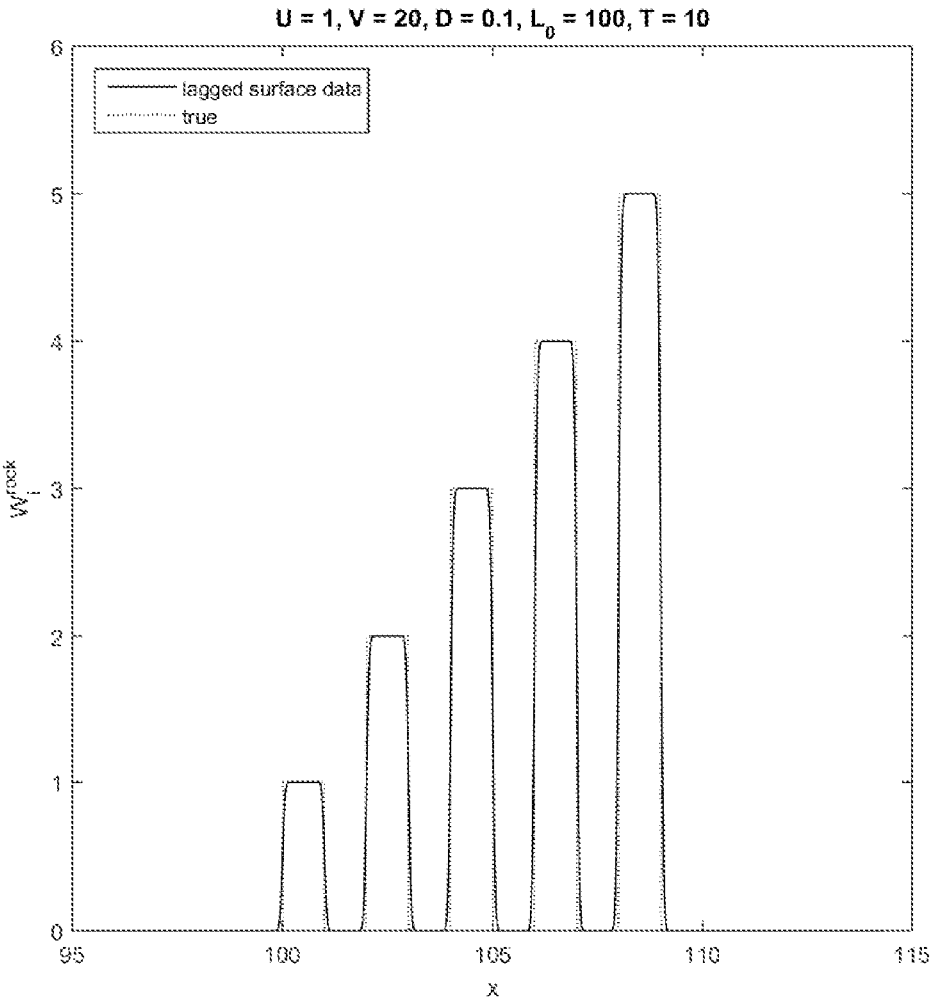
FIG. 4 is a graph showing an estimation of the concentration of formation for small cuttings and the effects of dispersion on small cuttings transport, with a dimensionless axial dispersion coefficient, D=0.1, according to one or more embodiments of the present disclosure.
Figure 5:
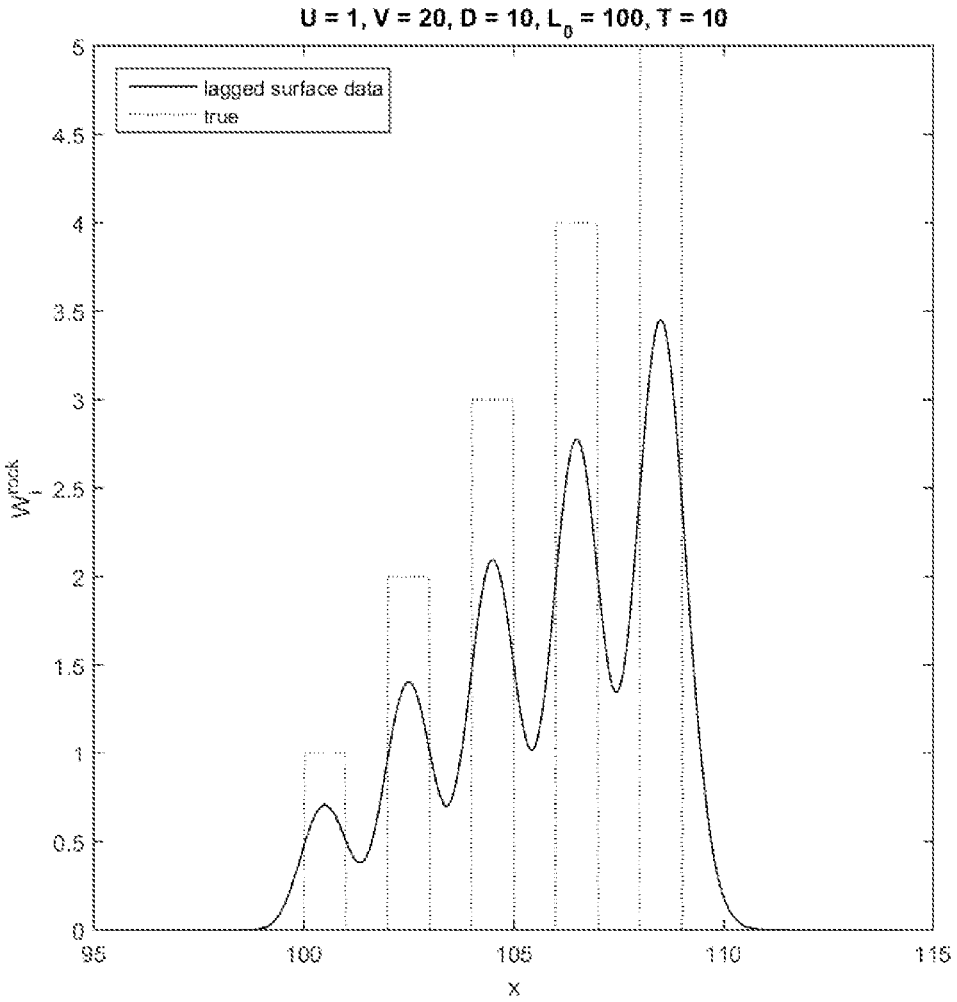
FIG. 5 is a graph showing an estimation of the concentration of formation for small cuttings and the effects of dispersion on small cuttings transport, with a dimensionless axial dispersion coefficient, D=10, according to one or more embodiments of the present disclosure.

FIGS. 4 and 5 both illustrate the effects of dispersion of the transport of small cuttings, where transport is simulated with the advection-diffusion equation (1) as explained above. The simulated cuttings concentrations are then lagged, and scaled to correct for dilution using equation (4), to estimate the incoming concentrations from the formation.

In FIG. 4, a small value, D=0.1 is taken as axial dispersion coefficient (assumed constant) and it can be seen that the effects of hydrodynamic dispersion are small. The modelled concentrations represented in FIG. 4 (solid line), have been obtained with a (dimensionless) rate of penetration U=1 between (dimensionless) times 0 and T=10 and zero thereafter, where the mud circulation velocity is V=10 and the initial depth of the well is $L_0=100$. The data was simulated out to t=20. It can be seen from FIG. 4 that the estimated concentrations (solid line) are close to the true values (dotted line), which correctly located in depth by simple lagging.

Turning to FIG. 5, the modelling parameters are the same as for FIG. 4, however a large value, D=10 is taken as axial dispersion coefficient (assumed constant). From FIG. 5 it can be seen that there is a smearing of spatial structure in the estimated formation concentration, and there are numerical discrepancies between the true and estimated formation concentrations.

Figure 6:
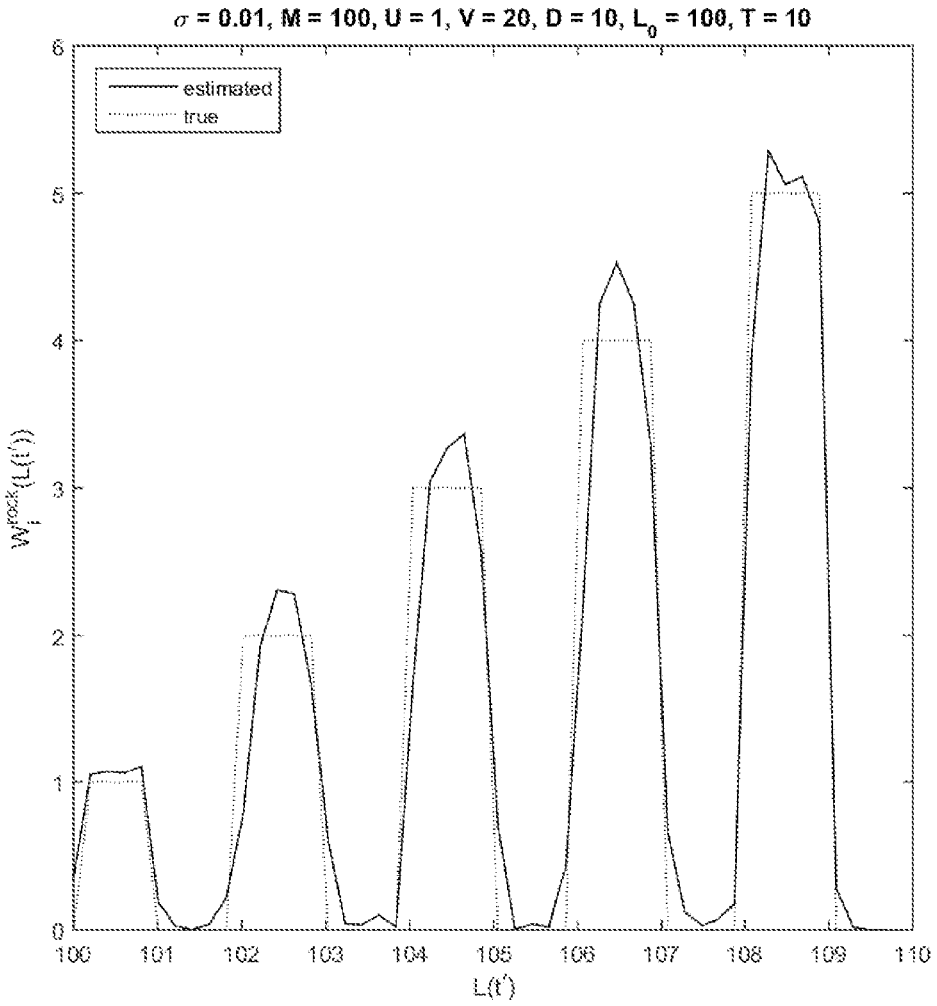
FIG. 6 is a graph showing the results of estimating the concentration of formation by correcting that data of FIG. 5 for the effects of diffusion, according to one or more embodiments of the present disclosure.

FIG. 6 shows the results of estimating the rock properties by correcting the data of FIG. 5 for the effects of diffusion using the minimization formulation. The formation composition in FIG. 6 is represented by values at 50 equispaced points, and the minimization was performed in this example using an active set algorithm which tests show is more effective than the others (see for example Gill, P. E., W. Murray, and M. H. Wright, *Practical Optimization*, London, Academic Press, 1981; sections 6.4 to 6.6.) The algorithm successfully sharpened the shape of the formation composition, allowing a better depiction of the layering and giving reasonable values for the layer properties. Yet more sophisticated approaches can be envisaged, for example a particle filter approach as described in US20150226049A1.

Step 130 (of FIGS. 1 and 2) as described above includes a stable deblurring mathematical algorithm (correcting for dispersion/diffusion) for the transport of small cuttings. In some embodiments, correcting for dispersion/diffusion may be made in a Bayesian manner, exploiting prior knowledge about the transport processes, about the character of formation composition variations, and constraints such as concentrations being non-negative for example. For example, the estimation problem can either focus on estimating the source terms describing formation composition in an advection-diffusion model for transport of small cuttings assuming the drilling fluid circulation rate and hydrodynamic dispersion/diffusion properties to be known, or can attempt to estimate the source terms and the flow rate and dispersion/diffusion values.

Specifically, a Bayesian mathematical formulation exploiting equation (5) below can be applied to the process of estimating the attributes of the downhole formations, as functions of position along the hole:

$$P(M_z \mid D) = \frac{P(D \mid M_z)P(M_z)}{P(D)} \tag{5}$$

In this expression, M represents a model which is a candidate representation of the formation compositions, and D is data representing the combined set of all the measured small cuttings attributes for every sample collected. $P(M_z|D)$ is known as the posterior probability and is the conditional probability that the statement $M_z$ is true given all the information we have; $P(M_z)$ is the prior probability, i.e. a representation of our state of knowledge before collecting any data. Accordingly, $P(M_z)$ represents knowledge before any observations are considered, and could, for example be based on an attribute distribution based on that observed in offset wells. $P(D|M_z)$, known as the 'likelihood', is the conditional probability of observing the data D given that the model is actually $M_z$.

Computing the likelihood $P(D|M_z)$ in this example involves using a forward model for small cuttings transport. In essence, the forward model may be run using the model parameters M (and other information such as the rate of penetration and the rates of drilling fluid circulation) so as to produce a prediction of those quantities which are observed. This prediction may then be compared with the actual observations, and the conditional probability of the observations may be computed on the basis of knowledge of the measurement errors.

The calculation of the likelihood P(D|M) in this case may be elaborate as the entire set of observations are involved. Once all these pieces of information are in place, the posterior probability is computed using equation (6), and yields a probability distribution over the whole set of possible models. Since this is a very large and high-dimensional set, representation of the distribution in a manner suitable for use by a human decision maker requires some form of data reduction or production of a small number of representative samples. Such methods are well known to those skilled in the art.

Application of the Derived Log of Formation Composition in Unconventional Wells

With reference to unconventional hydrocarbon wells (i.e. shale oil, shale gas), favourable zones for production, and hence for fracturing, can often be identified by their elevated solid hydrocarbon content or some other compositional characteristic or other characteristic or property indicating that they are particularly favourable for hydraulic fracturing. The method shown in FIG. 1 in particular, may be applied to unconventional hydrocarbon wells. In this case, it is not necessary to have access to large cuttings in order to determine the solid hydrocarbon content for this purpose since what is of interest is the formation composition, and not in any properties depending on the geometrical structure of the rock or its void space.

Therefore, using methods and systems of the present disclosure, solid hydrocarbon content can be adequately determined from analysis of small cuttings, or indeed from completely disaggregated material, provided only that this material is not mixed and containing contributions from different positions along the well. Put another way, what is important for completion planning is that the formation composition is accurately determined, at accurately determined locations along the well.

To this effect, the mathematical techniques, of which FIG. 6 shows an example, can be put to practical use. By mathematically processing surface measurements of the composition of samples of small cuttings by those or similar means, it is possible to construct a sharper and more accurate map of the formation composition along the length of the well than would result from simply time-lagging the cuttings according to equation (3). For example, if we were to select fracture locations on the basis of the conventional lagging approach, as illustrated in FIG. 5, then fractures placed at any depth between x=100 and x=110 would appear to connect with non-zero compositions in the formation. The more sophisticated data processing of FIG. 6, however, clearly reveals that some depths within this interval have zero composition (e.g. x=101.5, 103.5 etc.) whereas others (x=100.5, 102.5 etc.) have a non-zero composition. Planning the completion on the basis of the more sophisticated data collection and processing scheme should thus lead to a more productive well.

Matching Small and Large Cuttings Compositions to Ascribe a Depth for Large Cuttings Turning now to FIGS. 2 and 3, at step 140, the characterized composition of a drill cutting in the second sample is correlated with the estimated distribution (log of formation composition versus depth).

In particular, it may be assumed that the composition of the large cuttings (selected from the second sample) created at each depth is the same as the composition of small cuttings created at that same depth, and that both are the same as the total composition of the formation at that depth. It is conceivable that the compositions of large and small cuttings from the same depth differ, for example because the rock destruction process acts differently on different mineral grains within the same rock. Under this assumption, however, the composition of the formation drilled at each depth can be inferred reasonably accurately from composition measurements made on the small cuttings sample only.

The aim of the methods described herein is to match each large cutting from the second sample to the depth from which it originated. Since the composition of the large cutting is assumed to be the same as the composition of the small cuttings coming from the same depth, the problem is one of correlating the composition of the large cutting to the log of formation compositions derived from the small cuttings data (estimated at step 130 as described above).

By way of example, suppose that on each sample of small cuttings, N different compositional attributes have been determined, and that these have been used to create a log or map versus depth of the formation composition using a method like that of equation (3) or FIG. 6, as described above. Some or all of these N compositional attributes are now determined on a particular large cutting of interest. The list of values of the large cuttings attributes are now compared, depth by depth, with the lists of attributes determined from the small cuttings. A measure of the difference between the large- and small-cutting attributes is computed at each depth (for example, a weighted sum of the squares of the differences between the large and small cuttings samples attributes may be formed). The large cutting in the example above may then be ascribed to the depth for which this measure of mismatch is smallest.

At step 150, a depth of provenance is associated with a (large) drill cutting in the second sample. Given a second sample containing large cuttings (for which the transport velocity is not known) taken at a given instant at surface, the depths from which these cuttings have originated can then be inferred by finding the combination(s) of compositions from the small cuttings derived log which, in total composition, best matches the total composition of the sample of large cuttings.

In embodiments, step 140 described above (correlating the characterized composition of a drill cutting in the large second sample with the estimated distribution) makes use of constrained best matches between large cuttings compositions and the formation composition estimated from the small cuttings data. Where possible, the correlation (also referred to as 'matching') of step 150 can be constrained with a large cuttings transport model for example. The outcome may include a statement such as: "this large cutting, which exited the well at 12 noon on Monday, came from a measured depth (MD) 5,000 and 5,020 feet with probability 90%, the probabilities of coming from other MDs being 10%". In embodiments, prior knowledge such as a large cuttings transport model to supply bounds on transport rates is exploited and probabilities assigned for each proposed set of origins. For example, this would result in a set of statements such as: "the large cuttings exiting the well at 12 noon came 40% from MDs between 5,000 and 5,020 metres, and 60% from MDs between 5,020 and 5,030 metres, with probability 80%".

Examples of procedures which exploit Bayesian methods to compute the probability that the large cutting came from each depth are described below. The errors in determination of each of the attributes are quantified before starting the process, on the basis of characterization of the measurement apparatus used. A probability distribution for these errors is formed, for example on the basis that errors in each determination are normally distributed, are independent, and have zero mean and variance determined by testing the experimental apparatus used. In addition, prior information about the likely values of the attributes is assembled, for example on the basis of experience in offset wells.

The Bayes' theorem (5), as set out above, may again be exploited, this time to give the probability that the large cutting came from a given depth, in terms of the prior and error probabilities:

$$P(M_z \mid D) = \frac{P(D \mid M_z)P(M_z)}{P(D)}. \tag{6}$$

In this expression D denotes the observed data, namely the measured attributes of the large cutting; $M_z$ denotes the model, which we can express as the statement "the large cutting originated from depth z"; $P(M_z|D)$ is the conditional probability that the statement $M_z$ is true given all the information we have; and $P(M_z)$ is the prior probability, i.e. a representation of our state of knowledge before collecting any data. In this case, $P(M_z)$ represents a probability that the large cutting came from depth z. In the absence of offset well information we may take this probability to be uniform over all drilled depths (i.e. the cutting could have come from any level that had been drilled before the time at which it was collected), or we may construct a more sophisticated prior by making use of a hydrodynamic model for transport of large cuttings. P(D) is essentially a normalization constant which we shall ignore since only relative values of the posterior probability are needed here. The likelihood $P(D|M_z)$ can be computed using our characterization of the errors in the measurements in a manner well known to those skilled in the art, and for independent measurements and errors, can be written as a product of the individual measurement error probabilities.

Under the above mentioned assumptions of independence and normal distribution, for each individual attribute, the probability of obtaining a measurement D=d of the value of a particular attribute given that the true value of that attribute is $M_z$=m is $\exp(-(d-m)^2/2\sigma^2)/\sqrt{2\pi\sigma^2}$, where $\sigma^2$ is the variance of the measurement errors associated with the determination of the attribute in question. Once the posterior has been computed, we have a mathematically well-founded basis for ascribing a large cutting to a give depth, we might, for example, report that the large cutting should be associated with the depth which gives the largest value of $P(M_z|D)$. Alternatively the mean and variance, or indeed the whole probability distribution could be displayed, so as to indicate the range of uncertainty associated with the interpreted depth of origin of the large cutting in question.

A general feature of the Bayesian methodology is that it permits a rational treatment of missing data; through the calculational framework "answers" which depend on missing data are ascribed large uncertainties, but missing data does not cause the algorithms to fail. As a consequence, it may be possible to reduce the collection frequency requirements on small cuttings whilst still being able to provide useful information pertaining to the depth of provenance of large cuttings.

In some embodiments, a 'tracer' may additionally be used to constrain the transport model for the drill cutting in the second sample. The use of tracers and tracer materials is known in the art. For example, a tracer may be periodically ejected from a downhole tool, at known times. Travel time to surface then be determined by detecting arrival of the tracer at surface and this travel time could be used when ascribing cuttings depths of origin. Preferably, the tracer is an object chosen so as to have similar size and physical properties as typical cuttings of interest. As a result, its transport behaviour is similar to a large cutting, and the determined transport times more accurate.

A tracer may be thought of as an object carrying read-write memory. For example, such objects may be continually added into the mud stream at surface, where their time of addition would be written into the on-board memory. In embodiments, the time of arrival at the bit may be written into the on-board memory on arrival there (optimally because this could be computed reasonably accurately knowing the mod flow rate and drilling history). These times may be read out of the memory when the object returns to surface, having been transported up the annulus, and are written into a database along with the time of arrival at surface. By assembling data from many such objects in the database, it is possible to assemble statistics of the mean transport time and variations about this mean to constrain the large cuttings transport model. This statistical information could be used to represent the statistics of large cuttings transport, and an interpretation of the cuttings origins constrained that basis.

Once the assignments of large cuttings to wellbore depth have been performed, further properties such as the permeability or micro fossil characteristics may be inferred and against the estimated depths of origin.

It is desirable that the solids treatment equipment on the rig operates effectivity, in order to avoid excessive build-up of small cuttings in the drilling fluid from shallower depths which would mask those generated from the depths of interest.

It will be appreciated that sufficient cuttings in the drilling process must be generated to permit the analysis steps described above, and, in particular, sufficient cuttings that are small enough to be transported in the fluid without slipping. It will further be appreciated that this places requirements in the drilling fluid. For example, the solids carrying capacity of the drilling fluid, as characterized by its viscosity, yield stress, and shear thinning behaviour and its density compared to that of the formation rocks, must be sufficient that the settling of the small cuttings is insignificant over the time taken for a particular volume of drilling fluid to travel from the drill bit to the surface. For example, we might estimate the speed with which a small cutting would settle in the drilling fluid, using a suitable mathematical formula to relate settling speed to drilling fluid properties and flow rate, cutting size and density, and compare that speed with the average speed of the drilling fluid in the annulus (in the case of Newtonian drilling fluid rheology, Stokes' Law; for non-Newtonian rheology, a rough estimate can be made using Stokes Law with the viscosity taking the average value of that exhibited by the drilling fluid at the average flow rate in the annulus, or alternative a more accurate formula used). For settling to be negligible we require that the speed of settling be less than the average speed of drilling fluid in the annulus in proportion to the ratio of the depth resolution required in the log of downhole properties to the total depth of the well (i.e. if we require 10 meter resolution, and the well is 1000 metres deep, then the settling speed must be less than 1/100 of the average drilling fluid velocity). This ensures that the cuttings do not slip so far as to prejudice depth allocation on the basis of the advection diffusion equation where the advection velocity is the average drilling fluid velocity. A further, and much stricter condition, which may be relevant in some situations, is that the fluid rheology be such that small cuttings do not settle by a distance larger than the annulus diameter over the time it takes them to travel from the bit to surface.

It will be appreciated that the order of performance of the steps in any of the embodiments in the present description is not essential, unless required by context or otherwise specified. Thus most steps may be performed in any order. In addition, any of the embodiments may include more or fewer steps than those disclosed.

It will be appreciated that the term "comprising" and its grammatical variants must be interpreted inclusively, unless the context requires otherwise. That is, "comprising" should be interpreted as meaning "including but not limited to". Moreover, the invention has been described in terms of various specific embodiments using specific mathematical algorithms. However, it will be appreciated that these are only examples which are used to illustrate the invention without limitation to those specific embodiments.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

The foregoing outlines features of several embodiments and sets forth numerous details so that those skilled in the art may better understand the aspects of the present disclosure. Those skilled in the art should appreciate that the present disclosure may provide a basis for designing or modifying other processes and structures for carrying out the same purposes and/or achieving the same advantages of the embodiments introduced herein.

Although the present disclosure has been described with respect to specific details, it is not intended that such details should be regarded as limitations on the scope of the invention, except to the extent that they are included in the accompanying claims.

The invention claimed is:

1. A method of determining depths of provenance of drill cuttings contained in a drilling fluid received from a wellbore, the drilling fluid containing drill cuttings of different sizes that emerge from the wellbore at different recorded times, the drill cuttings originating from different formation layers at different depth along the wellbore, the method comprising:

a) extracting a first sample of drill cuttings from the drilling fluid, wherein the drill cuttings in the first sample are smaller than a first predetermined threshold;

b) repeating step a) to provide a plurality of first samples of drill cuttings that arrive at Earth's surface at different recorded times;

c) characterizing one or more formation attributes associated with said drill cuttings of the first samples, and characterizing the composition of the drilling fluid injected into the wellbore; and d) for each of the one or more formation attributes characterized at step c), estimating a distribution of formation attribute characterization versus depth of provenance, wherein estimating the distribution comprises solving a set of equations, including an advection-diffusion equation, which define a hydrodynamic transport within the drilling fluid of the drill cuttings characterized at step c) including the effect of diffusion and dispersion on the hydrodynamic transport.

2. The method according to claim 1, further comprising:

e) extracting a second sample of at least one drill cutting wherein the at least one drill cutting in the second sample is larger than a second predetermined threshold, the second predetermined threshold being larger than the first predetermined threshold;

f) characterizing one or more formation attributes associated with the at least one drill cutting in the second sample; and g) correlating the one or more characterized formation attributes associated with the at least one drill cutting in the second sample with the distributions estimated at step d), to thereby associate a depth of provenance with the at least one drill cutting in the second sample.

3. The method according to claim 2, wherein correlating the one or more characterized formation attributes in step g) comprises matching the one or more formation attributes associated with the drill cutting in the second sample as identified at step f) with the one or more distributions estimated at step d).

4. The method according to claim 2, further comprising: defining a transport model for the at least one drill cutting in the second sample, using the results of step g) to constrain the transport model, and calculating a depth of provenance for the at least one drill cutting using the constrained transport model.

5. The method according to claim 4, wherein defining the transport model for the at least one drill cutting in the second sample comprises including a tracer in the drilling fluid to be injected into the wellbore and determining a travel time for the tracer within the drilling fluid to further constrain the transport model, wherein the tracer has a similar composition and/or size to the at least one drill cutting in the second sample, and wherein the tracer is insoluble in the drilling fluid.

6. The method according to claim 2, further comprising determining a porosity and/or permeability of the at least one drill cutting in the second sample.

7. The method according to claim 1, wherein solving the set of equations in step d) comprises correcting for a hydrodynamic diffusion effect on the transport.

8. The method according to claim 1, wherein solving the set of equations in step d) comprises correcting for dilution effects on an identified formation attributes during transport by the drilling fluid.

9. The method according to claim 1, comprising subtracting the composition of the drilling fluid from a total composition of drill cuttings in said first sample.

10. The method according to claim 1, wherein characterizing the one or more formation attributes associated with drill cuttings in the first sample comprises determining one or more in the group of: total organic carbon content, kerogen content, bitumen content, hydrocarbon content, organic content, and inorganic mineralogy.

11. The method according to claim 7, wherein correcting for the hydrodynamic diffusion effect on the transport includes a Bayesian statistical calculation.

12. A system for determining depths of provenance of drill cuttings contained in a drilling fluid received from a wellbore, the drilling fluid containing drill cuttings of different sizes that emerge from the wellbore at different recorded times, the drill cuttings originating from different formation layers at different depth along the wellbore, the system comprising:

a drill cutting extraction unit for repeatedly extracting first samples of drill cuttings from the drilling fluid, to provide a plurality of first samples of drill cuttings that arrive at Earth's surface at different recorded times, wherein the drill cuttings in the first samples are smaller than a first predetermined threshold;

a sample analyzer for characterizing drill cuttings in the plurality of first samples, wherein characterizing drill cuttings in the plurality of first samples comprises characterizing one or more formation attributes associated with said drill cuttings of the first samples, and characterizing the composition of the drilling fluid injected into the wellbore; and a computer processor programmed to carry out instructions comprising:

for each of the one or more formation attributes characterized, estimating a distribution of formation attribute characterization versus depth of provenance, wherein estimating the distribution comprises solving a set of equations, including an advection-diffusion equation, which define a hydrodynamic transport within the drilling fluid of the drill cuttings characterized, including the effect of diffusion and dispersion on the hydrodynamic transport.

13. The system according to claim 12, wherein the drill cutting extraction unit is configured to extract a second sample of at least one drill cutting wherein the at least one drill cutting in the second sample is larger than a second predetermined threshold; wherein the sample analyzer is configured to characterize one or more formation attributes associated with the at least one drill cutting in the second sample; and wherein the instructions carried out by the computer processor further comprise correlating the one or more characterized formation attributes associated with the at least one drill cutting in the second sample with the estimated distributions, to thereby associate a depth of provenance with the at least one drill cutting in the second sample.

14. The system according to claim 13, wherein correlating the one or more characterized formation attributes comprises matching the one or more formation attributes associated with the at least one drill cutting in the second sample with the one or more estimated distributions.

15. The system according to claim 13, wherein the instructions carried out by the computer processor further comprise defining a transport model for the at least one drill cutting in the second sample, using the results of correlating the characterized drill cutting in the second sample to constrain the transport model, and calculating a depth of provenance for the at least one drill cutting using the constrained transport model.

16. The system according to claim 15, the system further comprising a tracer for inclusion into the drilling fluid to be injected into the wellbore, wherein defining the transport model for the at least one drill cutting in the second sample comprises determining a travel time for the tracer within the drilling fluid to further constrain the transport model, wherein the tracer has a similar composition and/or size to the at least one drill cutting in the second sample and wherein the tracer is insoluble in the drilling fluid.

17. The system according to claim 12, wherein solving the set of equations comprises correcting for a hydrodynamic diffusion effect on the transport.

18. The system according to claim 17, wherein correcting for the hydrodynamic diffusion effect on the transport includes a Bayesian statistical calculation.

19. The system according to claim 12, wherein solving said set of equations comprises correcting for dilution effects on the characterized formation attributes during transport by the drilling fluid.

20. The system according to claim 12, wherein the sample analyzer is configured to perform at least one of the following:

determine a porosity and/or permeability of the at least one drill cutting in the second sample;

determine one or more in the group of: total organic carbon content, kerogen content, bitumen content, hydrocarbon content, organic content, and inorganic mineralogy; and carry out at least one or more in the group of: Infra-red Spectroscopy (IR), ultraviolet spectroscopy, optical spectroscopy, gas chromatography, NMR, mass spectrometry, thermo-gravimetric analysis, pyrolysis, thermal extraction, wet chemical analysis, and x-ray analysis.

* * * * *